US006695577B1

(12) United States Patent
Susek

(10) Patent No.: US 6,695,577 B1
(45) Date of Patent: Feb. 24, 2004

(54) FAN GRILL

(75) Inventor: David N. Susek, St. Charles, MO (US)

(73) Assignee: American Power Conversion, West Kingston, RI (US)

( * ) Notice: Subject to any disclaimer, the term of this patent is extended or adjusted under 35 U.S.C. 154(b) by 0 days.

(21) Appl. No.: 10/219,196

(22) Filed: Aug. 13, 2002

(51) Int. Cl.[7] ..... F04D 29/70
(52) U.S. Cl. ..... 415/121.2; 416/247 R
(58) Field of Search ..... 415/121.2, 200, 415/191; 416/247 R; 417/423.9

(56) References Cited

U.S. PATENT DOCUMENTS 2,950,859 A * 8/1960 Kirk ..... 417/363
4,120,615 A * 10/1978 Keem et al. ..... 417/360
6,015,265 A 1/2000 Lasko et al. ..... 416/247
6,036,444 A * 3/2000 Barney et al. ..... 416/247 R
6,364,618 B1 4/2002 Moreno ..... 416/247

* cited by examiner

*Primary Examiner*—Ninh H. Nguyen
(74) *Attorney, Agent, or Firm*—Mintz, Levin, Cohn, Ferris, Glovsky and Popeo, P.C.

(57) ABSTRACT

A fan grill for use with a fan associated with an inlet ring is configured to flush mount in an inlet ring and to serve as a safety guard to help prevent finger insertion into, and to help inhibit debris from entering a fan. The fan grill can impede and disturb gas flow to a fan less than by using a non-flush mounted grill or guard. The fan grill includes radial ribs, concentric circular ribs and radial support ribs to form a grate, and tabs. The tabs and the radial support ribs are configured to bias the fan grill against a wall of an inlet ring to securely connect the fan grill in the inlet ring. The fan grill can be readily installed and securely connected to inlet rings or housings of existing fans.

20 Claims, 5 Drawing Sheets

FAN GRILL

FIELD OF THE INVENTION

The invention relates to a fan grill for use with a fan.

BACKGROUND OF THE INVENTION

Fans are often used to cool equipment that produces undesirable heat. Fans provide air circulation to distribute cooler air to and/or within equipment and to remove and exhaust warm air from equipment. For example, systems used with communications and information technology equipment employ fans to provide cooler air and/or to dissipate or remove heat produced by electronic components that may be undesirable. Rack-mounted equipment housed within racks and/or cabinets or other enclosures is particularly vulnerable to heat that can affect the performance and/or useful life of electronic components. To help protect the fans associated with equipment, fan grills and fan guards may be used to help prevent objects and to help inhibit debris from contacting fan blades and entering the fans.

SUMMARY OF THE INVENTION

In general, in an aspect, the invention provides a fan guard for use with a fan associated with an inlet including a wall defining a port. The fan guard includes a grate configured to inhibit insertion of a finger through the grate while permitting passage of air through the grate, a first bias member connected to the grate and configured to be biased against a first side of the wall of the inlet while the fan guard is mounted to the inlet, and a second bias member connected to the grate and configured to be biased against a second side of the wall of the inlet while the fan guard is mounted to the inlet.

Implementations of the invention may include one or more of the following features. The first bias member is flexible to bias the first and second bias members against respective sides of the inlet while the fan guard is mounted to the inlet. The first side is a bottom lower edge of the wall of the inlet and the first bias member includes a tab configured to connect to the bottom lower edge of the wall of the inlet. The tab comprises a stepped portion configured to connect to the bottom lower edge. The second bias member includes an elongated member extending from the grate and has a terminal end configured to mate with the second side of the wall of the inlet. The terminal end of the elongated member is concave.

Implementations of the invention may also include one or more of the following features. The first bias member includes a circumferential ridge configured to connect to the first side of the wall of the inlet. The first side is a bottom lower edge of the wall of the inlet and the circumferential ridge comprises a stepped portion configured to connect to the bottom lower edge. The second bias member includes an outermost rib defining a perimeter of the grate and has a concave outer surface.

Implementations of the invention may further include one or more of the following features. The fan guard is configured such that a top of the fan guard is substantially even with a top of the wall of the inlet when the fan guard is mounted to the inlet. The grate and the first and second bias members are configured such that the fan guard is inserted in the inlet and the first and second bias members are biased against respective sides of the inlet to mount the fan guard to the inlet. The fan guard is constructed of at least one of a plastic, a metal, a ceramic and a composite.

In general, in another aspect, the invention provides a fan guard for use with a fan associated with an inlet in a housing, the inlet having a bottom side defining a port and an inner side for guiding gas to the port and the housing having a surface in which the inlet is disposed. The fan guard includes a grate configured to inhibit insertion of a finger through the grate while permitting passage of air through the grate, means for biasing the fan guard upward against the bottom side of the inlet while the fan guard is mounted to the inlet, and means for biasing the fan guard downward against the inner side of the inlet while the fan guard is mounted to the inlet.

Implementations of the invention may include one or more of the following features. The means for biasing the fan guard upward against the wall includes a multiple of tabs connected to the grate and configured to connect to the bottom side of the inlet. Each tab includes a stepped portion configured to connect to the bottom side. The means for biasing the fan guard downward against the inner side includes a multiple of support ribs having terminal ends configured to mate with the inner side of the inlet. Each terminal end is concave. The fan guard is configured to be flush-mounted such that a top of the fan guard is substantially even with the surface of the housing, in which the inlet is disposed, while the fan guard is mounted in the inlet.

In general, in still another aspect, the invention provides a method of mounting a fan guard to a housing, the fan guard including a grate configured to inhibit passage of a finger through the grate while allowing passage of gas through the grate, the housing including an inlet having a bottom surface defining a port and an inner surface configured to direct gas to the port, the fan guard further including multiple tabs coupled to the grate and multiple ribs extending from the grate and having terminal ends adapted to mate with the inner surface. The method includes inserting the fan guard into the inlet, aligning the fan guard with the port, bending the tabs connected to the grate relative to the grate and inserting the tabs through the port to connect the tabs with the bottom surface, and allowing the tabs to bias the tabs and the terminal ends of the ribs against the bottom and inner surfaces, respectively, with the terminal ends of the ribs with the wall.

Implementations of the invention may include one or more of the following features. The bending and inserting of the tabs includes applying force to at least one of a top of the fan grill and the tabs.

Various aspects of the invention may provide one or more of the following advantages. A fan grill can be flush mounted to a gas, e.g., air, inlet ring associated with a fan. The fan grill can serve as a safety guard to help prevent finger insertion into, and to inhibit debris from entering, a fan while impeding and disturbing gas flow to the fan less than by using a non-flush mounted fan grill. The fan grill can impede and disturb gas flow to a fan less, e.g., about eight percent, than compared to gas flow to the fan without a fan grill or guard. The fan grill can be readily installed in a gas inlet ring that provides gas flow to a fan. The fan grill can securely connect to a gas inlet ring without mounting hardware, and can be used with existing gas inlet rings and fans. Insertion and/or removal of rack-mounted equipment may be facilitated.

These and other advantages of the invention, along with the invention itself, will be more fully understood after a review of the following figures, detailed description, and claims.

DETAILED DESCRIPTION OF THE INVENTION

Illustrative embodiments of the invention provide a fan grill for protecting a fan. More particularly, a fan grill is provided that may inhibit objects from entering and damaging a fan. The fan grill is preferably mounted to a gas inlet ring associated with a fan. The gas inlet ring defines a gas port that is positioned adjacent to an array of fan blades of the fan and helps guide gas to the fan. The fan grill is connected to the gas inlet ring to help inhibit objects from passing through the gas port and contacting the fan blades. Other embodiments of the fan grill are within the scope of the invention.

Figure 1:
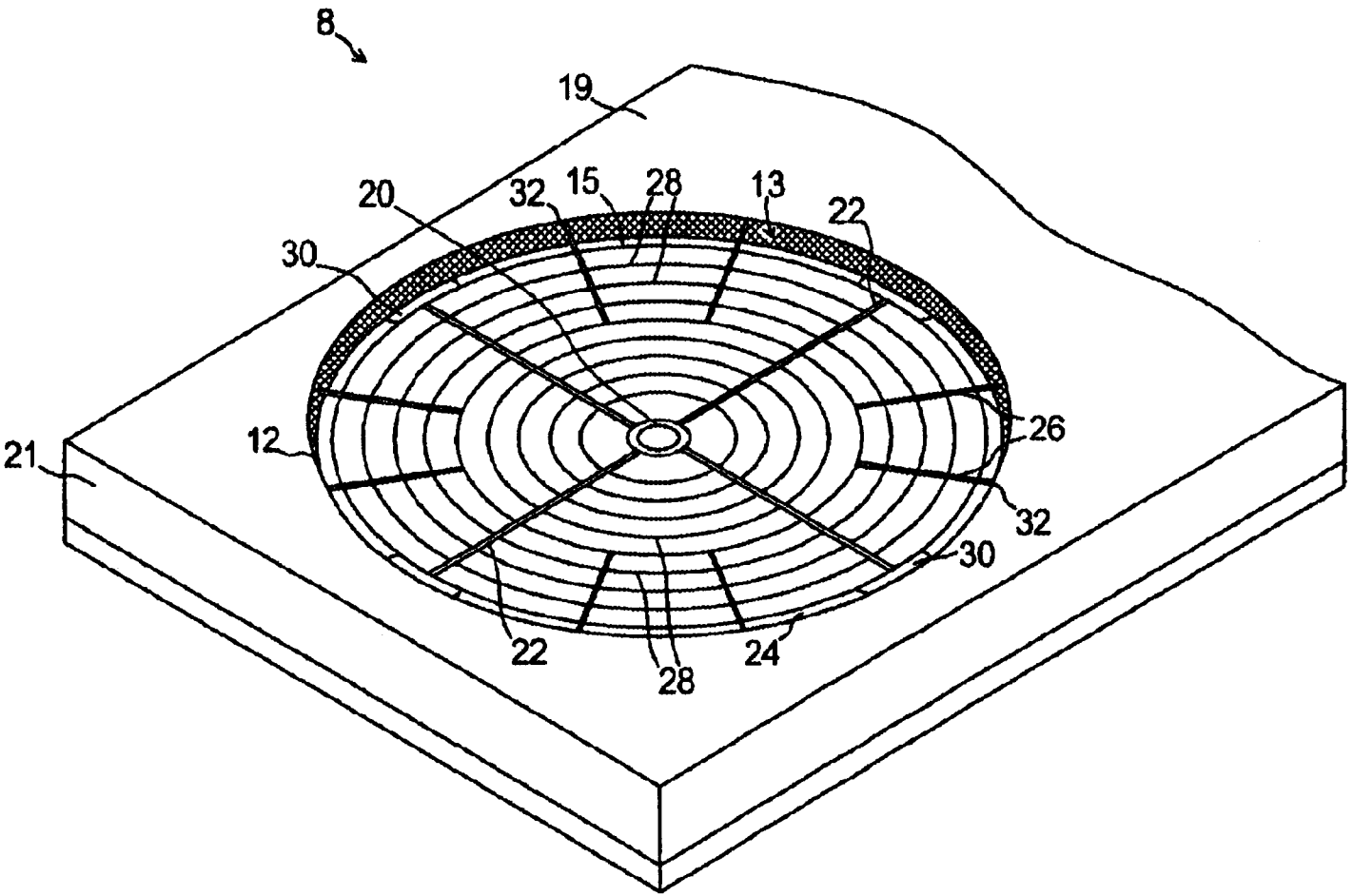
FIG. 1 is a perspective view of a ventilated rack-mounted component system including a fan grill.
Figure 2:
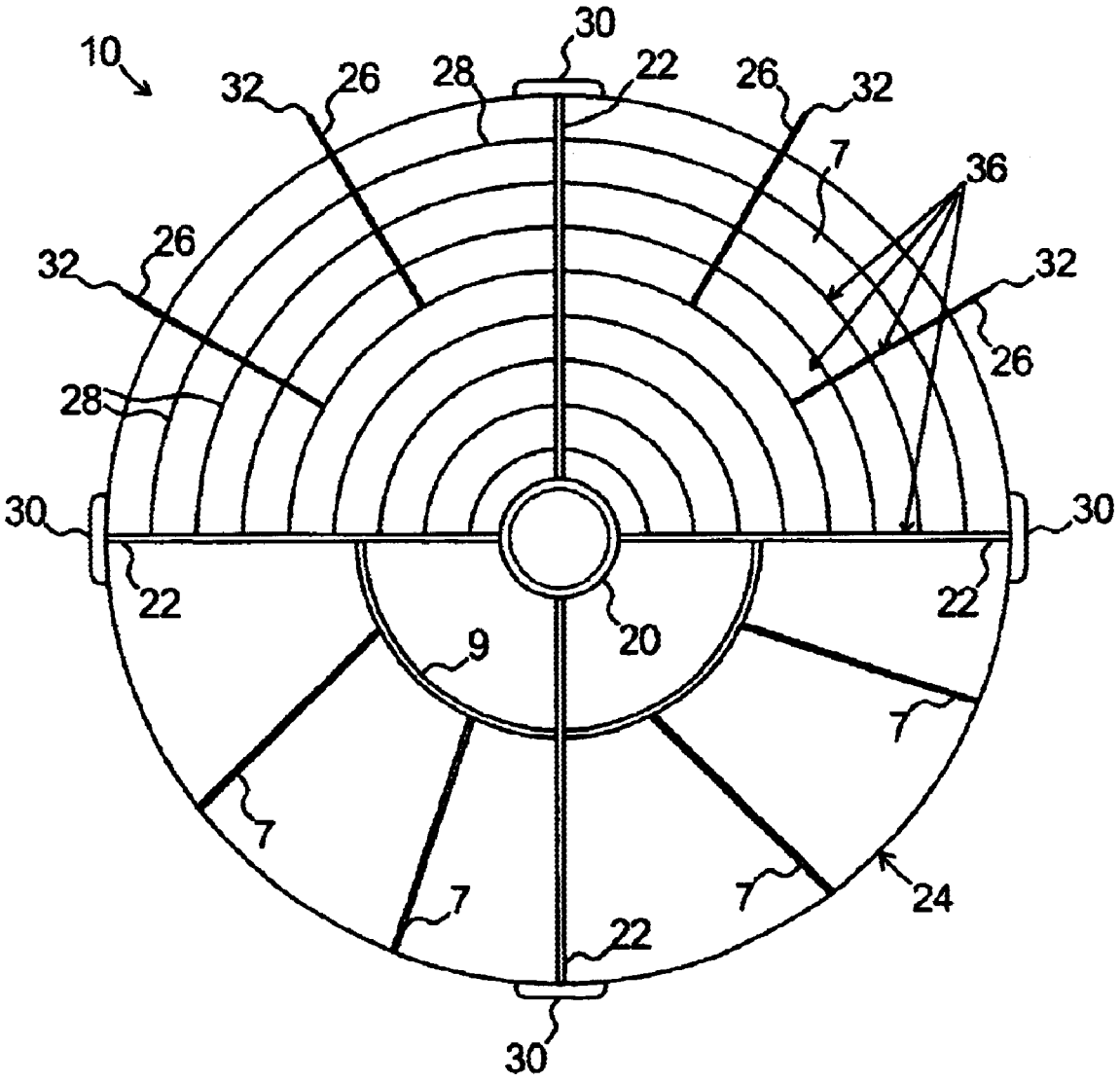
FIG. 2 is a top view of the fan grill shown in FIG. 1.

Referring to FIGS. 1–2, a ventilated rack-mounted component system 8 includes a housing 21, a fan grill 10, and a fan 9. The system 8 is configured to hold and exhaust heat from electronic equipment contained by the housing 8. The fan 9 is configured to expel hot or warm gas, e.g., air, from inside the housing 8 out of the housing 8 through a gas port 15 defined by a gas inlet ring 11, which is formed in the housing 8. The fan 9 may include, but is not limited to, motorized impellers, e.g., centrifugal impellers and, as shown in FIG. 2 for illustrative purposes, backward curved impellers 7. The fan grill 10 is configured and disposed to inhibit objects entering the housing 8 through the gas port 15.

Referring to FIG. 2, the fan grill 10 comprises radial ribs 22, concentric circular ribs 28, radial support ribs 26, and tabs 30. The radial ribs 22, concentric circular ribs 28 and radial support ribs 26 are depicted in FIG. 2 to comprise a portion of the fan grill 10 for illustrative purposes only to show a relation of the fan grill 10 to the fan 9 and fan blades 7, e.g., backward curved impellers, and it is understood that the ribs 22, 26 and 28 comprise the fan grill 10 of FIG. 1.

The ribs 22, 26 and 28 form a grate 36 configured to inhibit objects, e.g., a person's finger, from fitting through the grate 36 and reaching the fan 9, and to help inhibit debris from falling through the grate 36. The grate 36 is configured not to have openings and/or to provide an opening between the grate and the gas inlet ring 11 that are not greater than about 0.25 inch.

As shown, the fan grill 10 includes four of the radial ribs 22 equally spaced angularly about and extending from a center ring 20, and eight of the concentric circular ribs 28 equally spaced radially from the center ring 20 and coupled to the radial ribs 22. Each of the radial support ribs 26 extends beyond an outermost circular rib 24 and is connected to several, here five, of the concentric circular ribs 28. Each tab 30 is connected to the outermost circular rib 24 and is aligned with one of the radial ribs 22. The fan grill 10, however, is not limited to the configuration shown in FIGS. 1–2.

Figure 3:
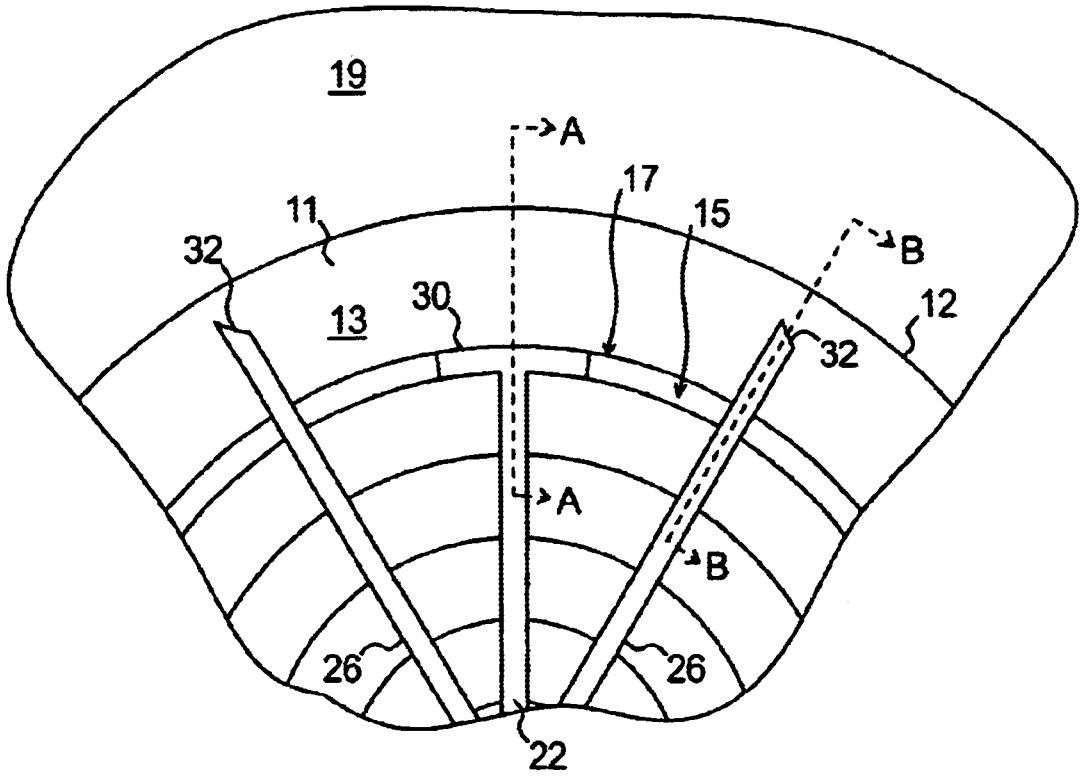
FIG. 3 is a top view of portions of the fan grill, a fan and a housing shown in FIG. 1.
Figure 4:
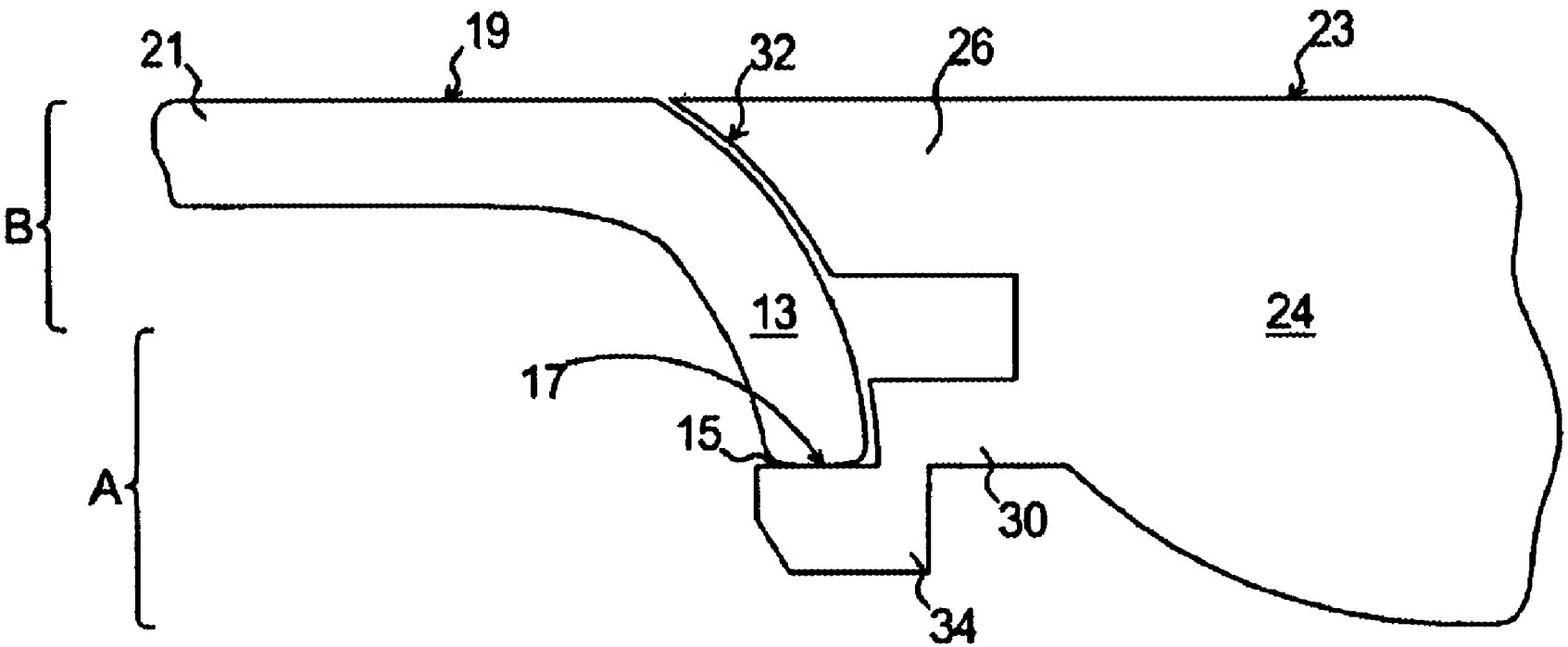
FIG. 4 is a cross sectional view of FIG. 3 at A—A and at B—B.

Referring to FIGS. 3–4, the tabs 30 and the radial support ribs 26 are configured to securely connect the fan grill 10 to a wall 13 of the gas inlet ring 11. The tabs 30 can engage a lower edge 17 of the wall 13 that extends downward away from a top 12 of the gas inlet ring 11 and that defines the gas port 15. Terminal ends 32 of the radial support ribs 26 are configured to mate with the wall 13. The tabs 30 and the radial support ribs 26 are configured to be biased against the lower edge 17 and the wall 13 when the fan grill 10 is mounted in the gas inlet ring 11. The tabs 20 are configured to bias upward against the lower edge 17 of the wall 13 and the radial support ribs 26 are configured to bias downward against the wall 13. The tabs 30 and the radial support ribs 26 are not coplanar. FIG. 4 shows the superposition of the planes of the tabs 30 and the radial support ribs 26 for illustrative purposes. The fan grill 10 is further configured such that, when mounted, a top 23 of the fan grill 10 is substantially even, e.g., even, slightly above, or slightly below, a plane 19 of the housing 21.

Each tab 30 includes a stepped portion 34 configured to engage the lower edge 17 of the gas inlet ring 11. The stepped portion 34 helps resist an upward force, e.g., gas exhausted by fan blades 7, applied to a bottom surface (not shown) of the fan grill 10 and helps secure the fan grill 10 in the gas inlet port 15.

Each terminal end 32 of each radial support rib 26 is configured to conform to the wall 13 of the gas inlet ring 11. Each terminal end 32 includes a substantially concave shape to mate with a substantially convex shape of the wall 13. The terminal ends 32 help the fan grill 10 engage the gas inlet ring II below the plane 19 of the housing 12. The radial support ribs 26 help resist a downward force applied to the top 23 of the fan grill 10 and help secure the fan grill in the gas inlet ring 11. The configurations of the terminal ends 32 are not limited to the substantially concave shape shown in FIGS. 3–4, but may include other configurations to mate the radial support ribs 26 with the wall 13 of the gas inlet ring 11.

The fan grill 10 is preferably constructed of a suitable material for use with units and assemblies in which fans are incorporated, e.g., gas distribution units of server racks. Suitable materials include, but are not limited to, plastics, e.g., acrylonitrile butadiene styrene (ABS), polyethylene, polypropylene, metals, e.g., aluminum, ceramics, composites and combinations of such materials. Connections between the ribs 22, 24, 26 and 28 are achieved by a method well known in the art, e.g., molding (for ABS) or brazing, which is suitable for use with the material(s) used to make the fan grill 10. The connections and material provide flexibility in the fan grill 10 to help with mounting of the fan grill 10 to the housing 8 and to help the tabs 30 and the radial support ribs 26 bias the fan grill 10 in place.

Figure 5:
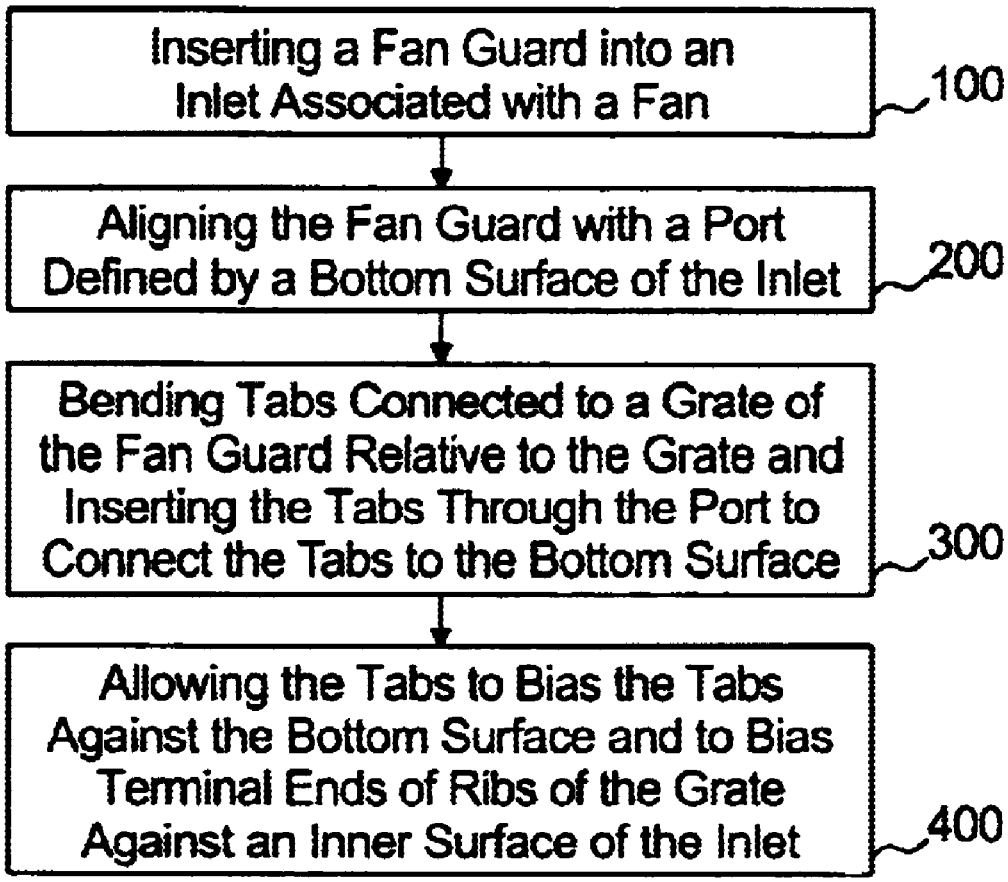
FIG. 5 is a flow diagram of a method for mounting the fan grill shown in FIG. 1 to a housing shown in FIG. 1.

Referring to FIG. 5, with further reference to FIGS. 1–4, a flow diagram illustrates a method for mounting the fan grill 10 to the housing 8. The method comprises inserting the fan grill 10 into the gas inlet ring 11 of the fan 9 (100) and aligning the fan grill 10 with the gas port 15 (200). The method further comprises bending the tabs 30 and inserting the tabs 30 thru the gas port 15 to connect the stepped portions 34 with the bottom lower edge 17 of the wall 13 of the gas inlet ring 11, e.g., by applying a force to the top 23 of the fan grill 10 and/or by applying a force on the tabs 30 (300). The method also comprises mating the terminal ends 32 of the radial support ribs 26 to the wall 13 of the gas inlet ring 11, e.g., by applying a force to the top 23 of the fan grill 10 and/or by applying a force on the tabs 30 (400).

Other embodiments are within the scope and spirit of the appended claims. For example, the fan grill 10 may include a different number of the radial ribs 22, the radial support ribs 26 and/or the circular concentric ribs 28 and may include different spacings between the ribs 22, 24, 26 and/or 28, and/or different spacings between the fan grill 10 and the gas inlet ring 11. The fan grill also may include different structures and/or configurations, e.g., fine gage mesh and other materials having a multiple of apertures, other than, or in addition to, the ribs 22, 24, 26, and/or 28 to form the grate 36.

The fan grill 10 may include a different number of tabs 30 connected to the outermost circular rib 24. The tabs 30 may be connected to the other portions of the fan grill 10 in manners other than, or in addition to, being connected to the outermost circular rib 24. The fan grill 10 also may include different structures and/or configurations other than the tabs 30 configured to bias upward against the lower edge 17 of the wall 13 of the gas inlet ring 11 when the fan grill 10 is mounted in the ring 11. For example, the fan grill 10 may include a circumferential ridge attached to a perimeter of the grate 36 and configured to connect to the lower edge 17.

In addition, the fan grill may include different structures and/or configurations other than the radial support ribs 26 configured to bias downward against the wall 13 when the fan grill 10 is mounted to the gas inlet ring 11. For example, the fan grill 10 may include the outermost circular rib 24 having a concave shape to mate with the wall 13 of the gas inlet ring 11.

Various alterations, modifications and improvements to the above description will readily occur to those skilled in the art. Such alterations, modifications and improvements are within the scope and spirit of the invention. Accordingly, the foregoing description is by way of example only and is not limiting. The invention's limit is defined only in the following claims and the equivalents thereto.

What is claimed is:

1. A fan guard for use with a fan associated with an inlet including a wall defining a port, the fan guard comprising:

a grate configured to inhibit insertion of a finger through the grate while permitting passage of air through the grate;

a first bias member connected to the grate and configured to be biased against a first side of the wall of the inlet while the fan guard is mounted to the inlet; and a second bias member connected to the grate and configured to be biased against a second side of the wall of the inlet while the fan guard is mounted to the inlet.

2. The fan guard of claim 1, wherein the first bias member is flexible to bias the first and second bias members against respective sides of the inlet while the fan guard is mounted to the inlet.

3. The fan guard of claim 1, wherein the first side is a bottom lower edge of the wall of the inlet and the first bias member includes a tab configured to connect to the bottom lower edge of the wall of the inlet.

4. The fan guard of claim 3, wherein the tab includes a stepped portion configured to connect to the bottom lower edge.

5. The fan guard of claim 1, wherein the first bias member includes a circumferential ridge configured to connect to the first side of the wall of the inlet, wherein the first side is a bottom lower edge of the wall of the inlet and the circumferential ridge includes a stepped portion configured to connect to the bottom lower edge.

6. The fan guard of claim 1, wherein the second bias member is an elongated member extending from the grate and has a terminal end configured to mate with the second side of the wall of the inlet.

7. The fan guard of claim 6, wherein the terminal end is concave.

8. The fan guard of claim 1, wherein the second bias member includes an outermost rib defining a perimeter of the grate having a concave outer surface.

9. The fan guard of claim 1, wherein the grate and the first and second bias members are configured such that the fan guard is inserted in the inlet and the first and second bias members are biased against respective sides of the inlet to mount the fan guard to the inlet.

10. The fan guard of claim 1, wherein the fan guard is configured such that a top of the fan guard is substantially even with a top of the wall of the inlet when the fan guard is mounted to the inlet.

11. The fan guard of claim 1, wherein the first side is a bottom lower edge of the inlet, the fan guard further includes at least another first bias member, wherein the first bias members include a multiple of tabs, each tab includes a stepped portion configured to connect to the bottom lower edge of the wall of the inlet, the fan guard further includes at least another second bias member, and wherein the second bias members include a multiple of support ribs having terminal ends configured to mate with the second side of the wall of the inlet, each terminal end being concave.

12. The fan guard of claim 1, wherein the fan guard is constructed of at least one of a plastic, a metal, a ceramic and a composite.

13. A fan guard for use with a fan associated with an inlet in a housing, the inlet having a bottom side defining a port and an inner side for guiding gas to the port, the housing having a surface in which the inlet is disposed, the fan guard comprising:

a grate configured to inhibit insertion of a finger through the grate while permitting passage of air through the grate;

means for biasing the fan guard upward against the bottom side of the inlet while the fan guard is mounted to the inlet; and means for biasing the fan guard downward against the inner side of the inlet while the fan guard is mounted to the inlet.

14. The fan guard of claim 13, wherein the means for biasing the fan guard upward against the wall includes a multiple of tabs connected to the grate and configured to connect to the bottom side of the inlet.

15. The fan guard of claim 14, wherein each tab includes a stepped portion configured to connect to the bottom side.

16. The fan guard of claim 15, wherein the means for biasing the fan guard downward against the inner side includes a multiple of support ribs having terminal ends configured to mate with the inner side of the inlet.

17. The fan guard of claim 16, wherein each terminal end is concave.

18. The fan guard of claim 17, wherein the fan guard is configured to be flush-mounted such that a top of the fan guard is substantially even with the surface of the housing, in which the inlet is disposed, while the fan guard is mounted in the inlet.

19. A method for mounting a fan guard to a housing, the fan guard including a grate configured to inhibit passage of a finger through the grate while allowing passage of gas through the grate, the housing including an inlet having a bottom surface defining a port and an inner surface configured to direct gas to the port, the fan guard further including multiple tabs coupled to the grate and multiple ribs extending from the grate and having terminal ends adapted to mate with the inner surface, the method comprising:

inserting the fan guard into the inlet;

aligning the fan guard with the port;

bending the tabs connected to the grate relative to the grate and inserting the tabs through the port to connect the tabs with the bottom surface; and allowing the tabs to bias the tabs and the terminal ends of the ribs against the bottom and inner surfaces, respectively, with the terminal ends of the ribs with the wall.

20. The method of claim 19, wherein bending and inserting the tabs includes applying force to at least one of a top of the fan grill and the tabs.

* * * * *